United States Patent [19]

Savage, Jr.

[11] Patent Number: 5,071,375

[45] Date of Patent: Dec. 10, 1991

[54] ELECTRICAL CONTACT AND MULTIPLE CONTACT ASSEMBLY

[76] Inventor: John M. Savage, Jr., 538-B Via De La Valle, Solana Beach, Calif. 92075

[21] Appl. No.: 468,010

[22] Filed: Jan. 22, 1990

[51] Int. Cl.[5] ..... H01R 13/00

[52] U.S. Cl. ..... 439/853

[58] Field of Search ..... 439/78, 81, 82, 83, 439/84, 284, 290, 291, 295, 851, 852, 853, 854, 885

[56] References Cited

U.S. PATENT DOCUMENTS

| | | | |
|---|---|---|---|
| 1,747,896 | 2/1930 | Gates . | |
| 2,042,199 | 5/1936 | Thomas . | |
| 2,396,725 | 3/1946 | Thomas, Jr. | 439/590 |
| 2,796,593 | 6/1957 | Offerman . | |
| 2,829,359 | 4/1958 | Ritter . | |
| 2,949,595 | 8/1960 | Deleman . | |
| 2,951,226 | 8/1960 | Gittens . | |
| 2,977,562 | 3/1961 | Benson | 439/853 |
| 3,335,387 | 8/1967 | Mueller . | |
| 3,601,786 | 8/1971 | Brubaker | 439/853 |
| 3,621,445 | 11/1971 | Horecky et al. | 439/81 |
| 3,663,931 | 5/1972 | Brown | 439/885 |
| 3,887,803 | 6/1975 | Savage, Jr. . | |
| 3,975,072 | 8/1976 | Ammon | 439/78 |
| 4,035,681 | 7/1977 | Savage, Jr. . | |
| 4,195,330 | 3/1980 | Savage, Jr. . | |
| 4,471,414 | 9/1984 | Savage, Jr. . | |
| 4,727,648 | 3/1988 | Savage, Jr. . | |
| 4,837,927 | 6/1989 | Savage, Jr. . | |

FOREIGN PATENT DOCUMENTS

| | | |
|---|---|---|
| 1464176 | 2/1969 | Fed. Rep. of Germany . |
| 2250007 | 5/1974 | Fed. Rep. of Germany . |
| 2918620 | 11/1980 | Fed. Rep. of Germany . |
| 2390032 | 1/1978 | France . |

*Primary Examiner*—Joseph H. McGlynn
*Attorney, Agent, or Firm*—William W. Haefliger

[57] ABSTRACT

An electrical contact which comprises a generally tubular metallic body defining an axis which is vertically elongated, having an upper generally annular portion and a lower generally annular portion spaced axially below the upper portion; elongated spring fingers extending generally in the elongation direction of the body, the fingers having anchored ends integral with one of the generally annular portions, free ends spaced from the anchored ends, and elongated mid-portions which are deflected toward the axis, whereby the fingers may frictionally grip the exterior of a terminal pin inserted axially into the body; the body having an open upper end, and a closed lower end adapted to mount the body on a panel to extend upwardly therefrom; the body upper and lower generally annular ends being interconnected so that the body and spring fingers are unitary.

32 Claims, 5 Drawing Sheets

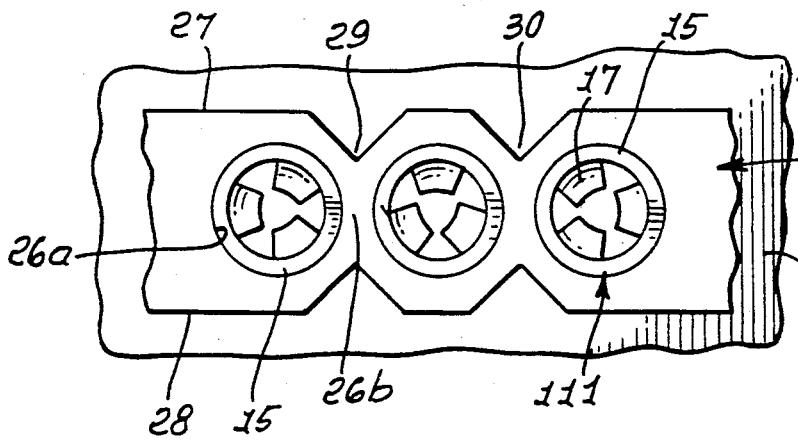
FIG. 12.
FIG. 13.
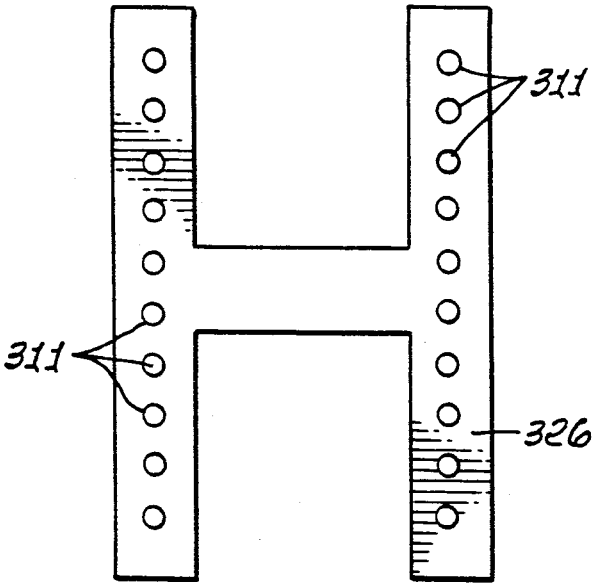
FIG. 15.
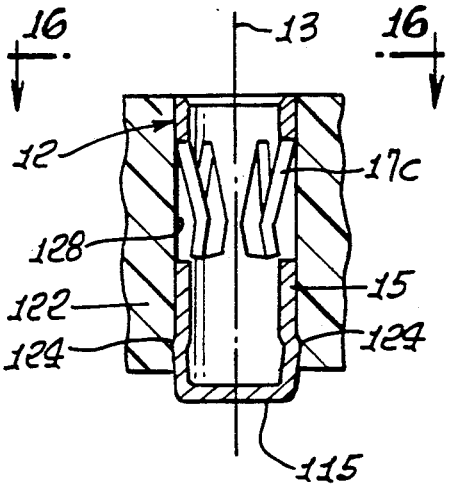
FIG. 16.
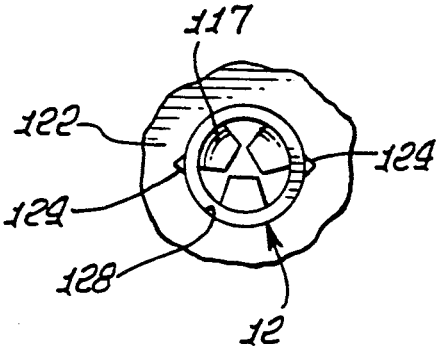

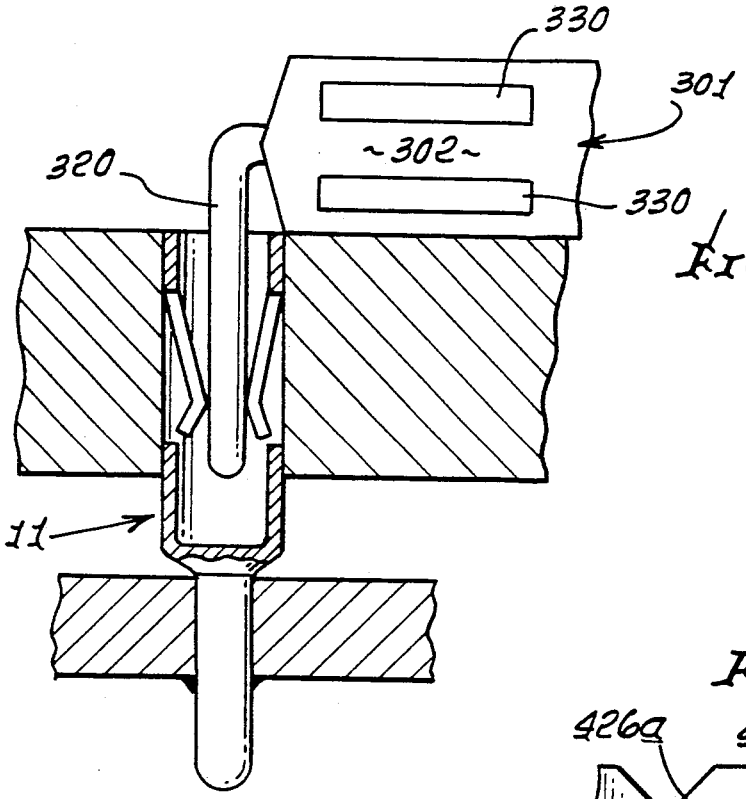
FIG. 14.
FIG. 19.
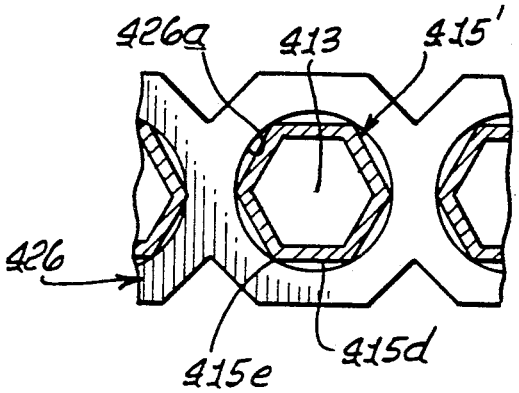
FIG. 17.
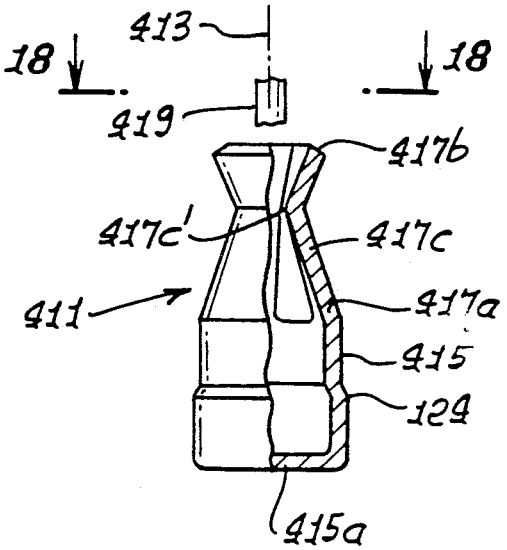
FIG. 18.
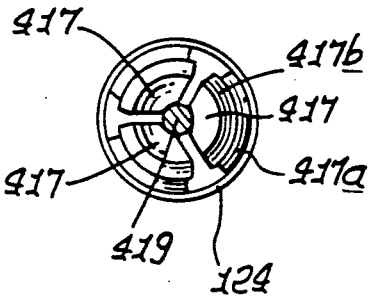

ELECTRICAL CONTACT AND MULTIPLE CONTACT ASSEMBLY

BACKGROUND OF THE INVENTION

This invention relates generally to electrical contacts, and to contacts on circuit boards; more particularly, it concerns providing a basic one-piece contact that has multiple modes of connection to a circuit board as well as connection to circuit components, such as chip leads, for example.

In my U.S. Pat. Nos. 4,195,330 and 4,837,927, there are described means for mounting circuit components, and a light unit, such as an LED for example, to a panel with unusual advantages.

There is presently a need for mounting circuit contacts to circuit boards in different ways or positions. To my knowledge, no way was known prior to the present invention to attach a unitary circuit contact to a discrete mount, in multiple modes, facilitating its positioning in different ways to a circuit board, or to provide a basic unitary contact which optionally connects to the board in different modes, thereby to achieve surprisingly advantageous results as will appear. These include the connection of the contact closed to a mount, lower end below spring fingers which are above that connection, the spring fingers engaging a terminal pin.

SUMMARY OF THE INVENTION

It is a major object of the invention to provide a mount and a method of assembly thereof that facilitates the above described multiple attachment and mounting modes, with attendant further advantages including ease and rapidity of mounting and assembly, low bulk and small overall size, and isolation of spring finger contact elements from the mounting of the contact to a panel for example. Basically, the invention is embodied in a contact that comprises:

a) a generally tubular metallic body defining an axis which is vertically elongated, having an upper generally annular portion and a lower generally annular portion spaced axially below said upper portion, b) elongated spring fingers extending generally in the elongation direction of said body, said fingers having i) anchored ends integral with one of said generally annular portions, ii) free ends spaced from said anchored ends, and iii) elongated mid-portions which are deflected toward said axis, whereby said fingers may frictionally grip the exterior of a terminal pin inserted axially into said body, c) the body having an open upper end, and a closed lower end adapted to mount the body on a panel to extend upwardly therefrom, d) said body upper and lower generally annular ends being interconnected so that the body and spring fingers are unitary.

As will appear, the elongated portions of the spring fingers may taper linearly toward the contact axis, or may taper toward and away from that axis relative to grip edges of the fingers, all between the upper and lower annular body portions, thereby isolating the fingers and their terminal pin gripping edges and functions from the mount or panel to which the contact is connected.

The body has a closed lower end adapted to be surface mounted to the panel; or the contact body may incorporate an elongated tubular stem integral with the body lower portion and projecting downwardly, axially, for reception in an opening forward in the panel. That stem also has a closed lower end.

Further, it is another object to provide multiple of the contacts extending in laterally spaced, longitudinally axially parallel relation; and a carrier for the contacts and extending closely about the body upper and lower annular portions to hold the contacts in the axially parallel relation. The carrier is configured to allow "break-off" of unwanted contacts, as will appear.

These and other objects and advantages of the invention, as well as the details of an illustrative embodiment, will be more fully understood from the following specification and drawings, in which:

DRAWING DESCRIPTION

FIG. 12 is a top plan view taken on lines 12—12 of FIG. 11;

FIG. 13 is a top plan view of a support for the multiple contacts of various types as in FIGS. 1, 3, 7, and 9 for example;

FIG. 14 is an enlarged elevation showing a chip body with terminal pins, one such pin received in a contact of FIG. 3 type, in turn mounted to a circuit board;

FIG. 15 is a view like FIG. 7 showing a modification;

FIG. 16 is a top plan view taken on lines 16—16 of FIG. 15;

FIG. 17 is a view like FIG. 8 showing a modification;

FIG. 18 is a top plan view on lines 18—18 of FIG. 17;

FIG. 19 is a view like FIG. 12 showing the FIG. 17 device received in a carrier;

DETAILED DESCRIPTION

Figure 1:
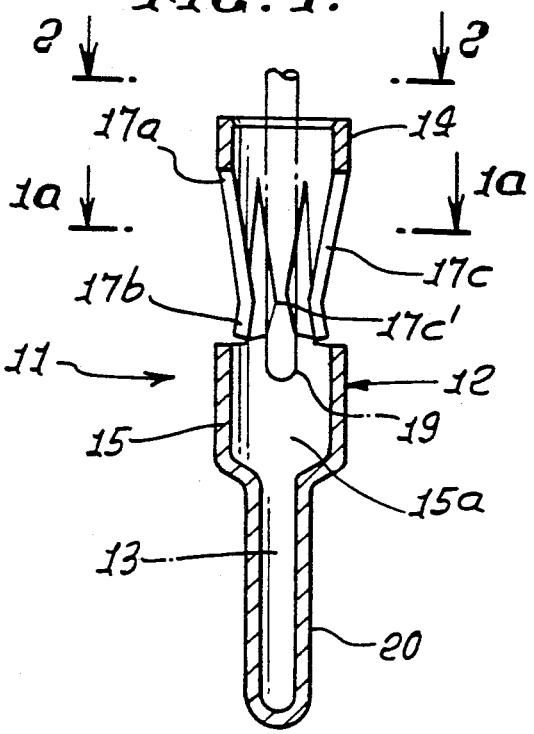
FIG. 1 is a side elevation, in section, showing one form of the contact of the invention.
Figure 2:
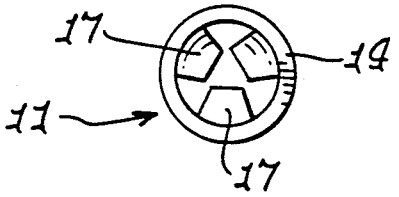
FIG. 2 is a top plan view on lines 2—2 of FIG. 1.

In FIGS. 1 and 2, the thin, walled, metallic (berillium for example) contact 11 has a generally tubular metallic body 12 defining a vertical axis 13 which is vertically elongated. The body has an upper generally annular portion 14, and a lower generally annular portion 15 spaced axially below the upper portion, these two portions being interconnected as by an intermediate body wall 16, seen in FIG. 1*a*.

Figure 1A:
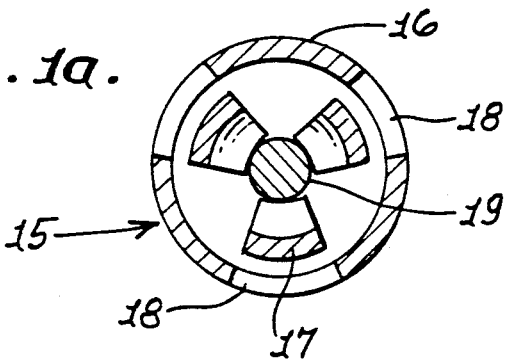
FIG. 1*a* is a section taken on lines 1*a*–1*a* of FIG. 1.

Elongated spring fingers 17 extend generally in the elongation direction of the body 12, and may for example be struck from wall 16, as is the case in FIG. 1*a*, showing wall regions or gaps 18 from which the fingers were struck or deflected inwardly from. The fingers are characterized by:

i) anchored ends integral with one of the generally annular portions (see for example finger ends 17*a* integral with upper annular portion 14)

ii) free ends spaced from the anchored ends (see for example free ends 17*b* spaced closer to lower body portion 15 than to upper body portion 14)

iii) elongated mid-portions which are effectively deflected toward axis 13, whereby the fingers may frictionally grip the exterior of a terminal pin inserted axially into the body (see the mid-portions 17*c* extending between 17*a* and 17*b*, and having local inner grip extents 17*c*' frictionally gripping the side wall of a terminal pin 19. The fingers have certain sections, between 17*a* and 17*c*' that taper toward axis 13, and other sections, between 17*c*' and 17*b* that taper away from that axis.).

The finger upper ends 17*a* typically extend in arcuate segments, about axis 13, and the fingers themselves, throughout their mid portions 17*c* may also extend arcuately about axis 13, increasing their resilient spring rates (i.e., stiffening them against outward bending deflections as the pin 19 is inserted downwardly past grip extents 17*c*').

It will be noted that the described structure may be entirely unitary, simplifying the construction and increasing reliability, the mounting of the body lower portion 15 to a circuit board being isolated from the spring fingers. Lower tubular portion 15 is hollow as at 15*a*, and allows adequate downward penetration of the terminal pin past the grip extents 17*c*' to assure required gripping without lateral binding.

Figure 3:
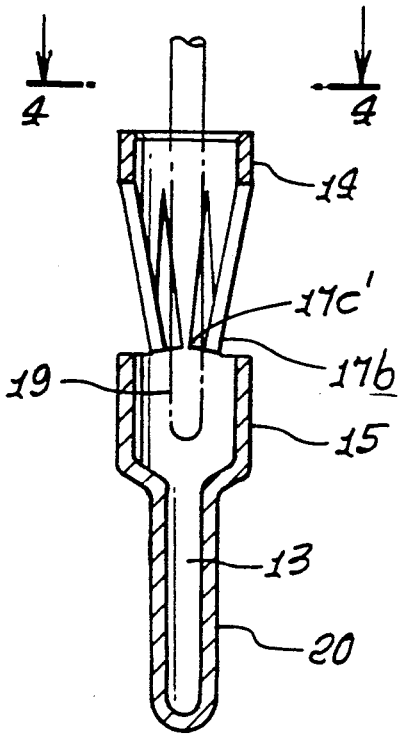
FIG. 3 is an elevation showing a variation of the FIG. 1 form of the invention.
Figure 4:
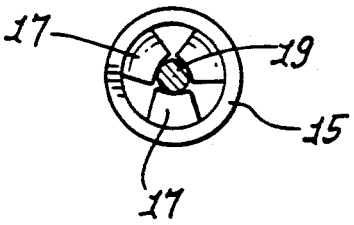
FIG. 4 is a top plan view taken on lines 4—4 of FIG. 3.

The contact of FIGS. 3 and 4 is the same as in FIGS. 1 and 2 except that the fingers taper linearly toward axis 13 throughout their extents. This locates grip extents 17*c*' at or near the lower free ends 17*b* of the fingers.

In both forms of the contact, as seen in FIGS. 1–4, an elongated tubular stem 20 is integral with the body lower annular portion 15, and projects axially downwardly for reception into an opening formed in a mounting panel. See openings 21 in panel 22 in FIG. 5, the lowermost closed extent 20*a* of the tubular stem projecting below the panel. Solder connections of stem lower extents 20*a* to the metallic panel appear at 23, and may be formed as by wave soldering. Note that the diameters of the stems 20 are substantially reduced relative to the diameter of the contact lower tubular portion 15, a tapered step shoulder 15*c* being formed at the junction of the end of portion 15. Stems 20 are typically integral with and unitary with, the portions 15; and lowermost portions 20*a* of the stems have rounded, i.e., convex surfaces at 20*a*', to easily guide into and through openings 21.

Figure 5:
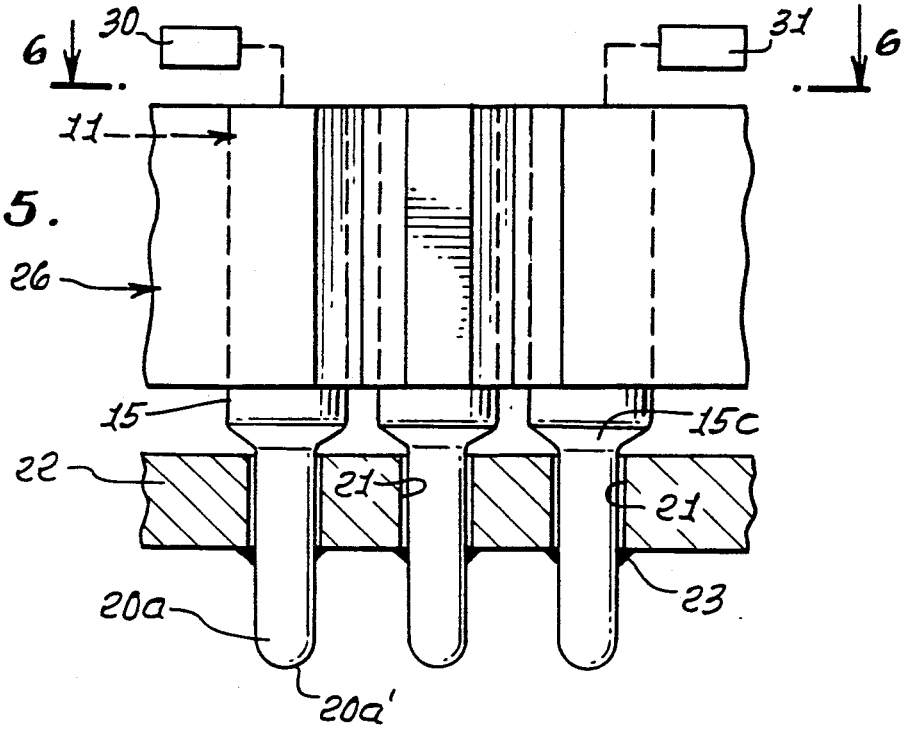
FIG. 5 is an elevation, partly in section, showing an assembly of contacts of FIG. 1 type, with lower stem terminals projecting through openings in a circuit board.
Figure 6:
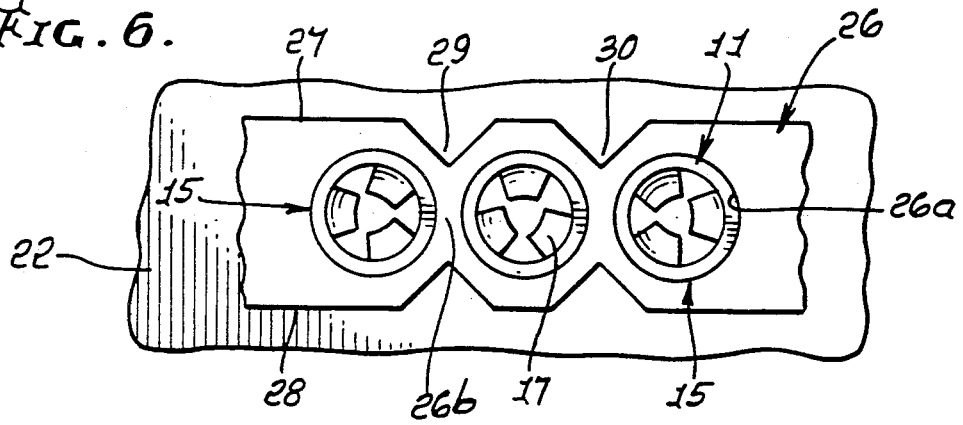
FIG. 6 is a top plan view on lines 1—1 of FIG. 5.

FIGS. 5 and 6 illustrate multiple of the contacts of either FIG. 1 or FIG. 3 form, extending in laterally spaced, longitudinally axially parallel relation; and a carrier 26 for the contacts and extending closely about the upper and lower annular portions 14 and 15 of the bodies 12 to hold the multiple contacts in axially parallel relation. That carrier may for example consist of molded plastic (synthetic resinous) material. The body portions fit into bores 26*a* in 26. FIG. 6 shows the provision of reduced carrier thickness at region 26*b* intermediate successive of the contacts, to provide preferential break-away or break-off loci. Thus, for a laterally elongated strip, as seen in FIG. 6 (see lateral walls 27 and 28 of the strip, notched at 29 and 30), the number of contacts to be used in a fixed series can be quickly selected by preferentially breaking off the strip at any selected locus or region 26*b* of reduced thickness, between successive of the contacts.

Figure 11:
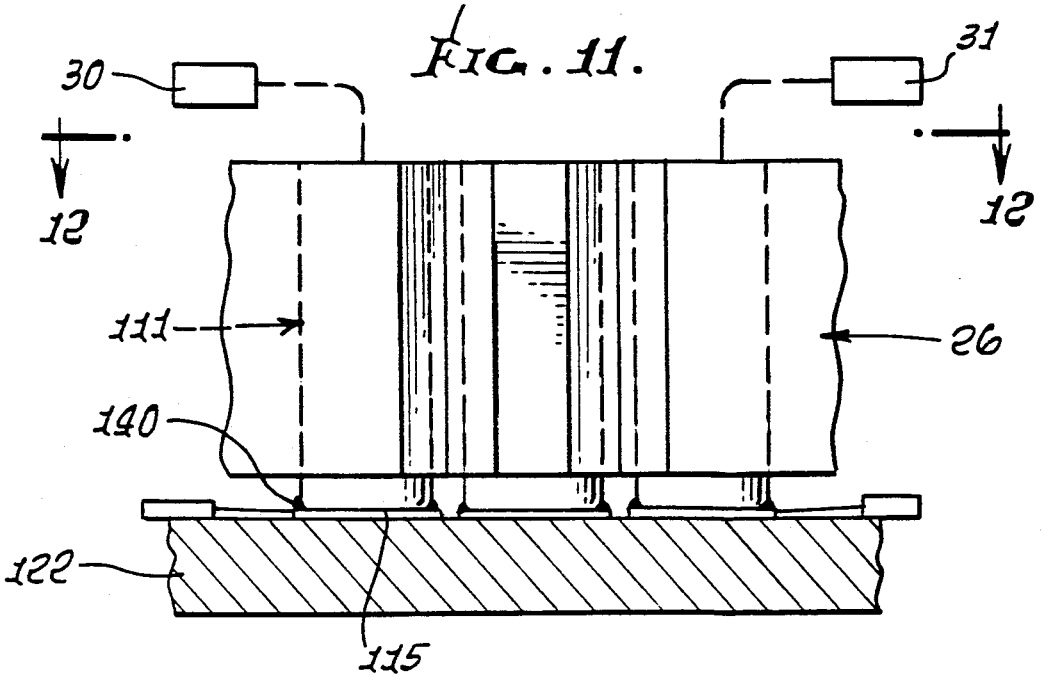
FIG. 11 is an elevation, partly in section, showing an assembly of contacts of FIG. 7 type with lower ends surface mounted on a circuit board.

Circuitry associated with the pins 19 inserted into the contacts is schematically seen at 30 and 31 in FIG. 11.

Figure 7:
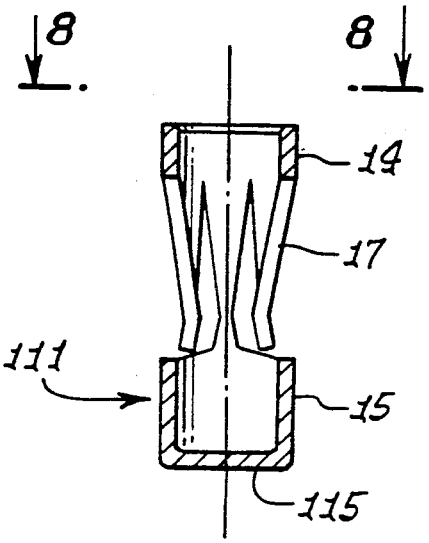
FIG. 7 is a side elevation, in section, showing yet another form of the contact.
Figure 8:
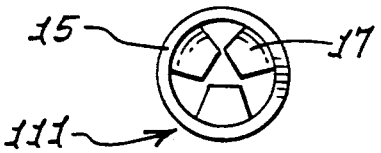
FIG. 8 is a top plan view taken on lines 8—8 of FIG. 7.

In FIGS. 7 and 8, the contact 111 is the same as in FIGS. 1 and 2, and therefore bears the same identifying numbers except for the following: instead of an integral stem 20, as referred to in FIGS. 1 and 2, the lower end of the portion 15 is closed as at end wall 115, integral with 15. This allows direct surface mounting of the end wall 115 to a panel 122, as seen in FIGS. 11 and 12. As shown, solder 140 forms about and connects the end walls 115 of multiple contacts to panel 122, adjacent which end walls 115 extend.

Figure 9:
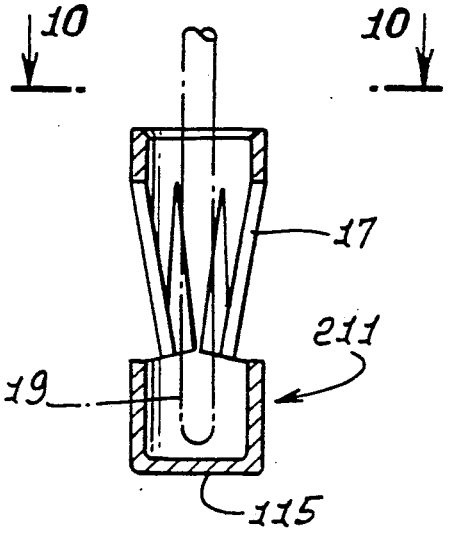
FIG. 9 is an elevation showing a variation of the FIG. 7 form of the invention.
Figure 10:
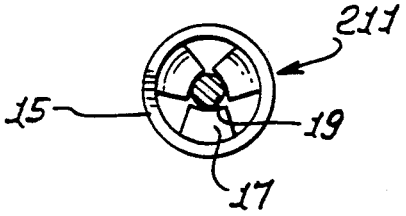
FIG. 10 is a top plan view taken on lines 10—10 of FIG. 9.

In FIGS. 9 and 10, the contact 211 is the same as in FIGS. 3 and 4, and therefore bears the same identifying numerals except for the following: instead of integral stem 20 as referenced in FIGS. 3 and 4, the lower end of the body section 15 is closed, as at end wall 115, integral with 15, the same as described in FIGS. 7 and 8, allowing surface mounting, as described in FIGS. 11 and 12 above.

FIG. 13 shows multiple contacts 311 of the type described in FIGS. 1 and 2, 3 and 4, 5 and 6, or 7 and 8, embedded in a plastic carrier 326 having H-shape.

FIG. 14 shows a microcircuit chip 301 having a body 302 from which terminals 320 extend; and a typical pin 320 extends into a contact 11 as of FIGS. 1 and 2 type, referred to above. Chip 301 contains electrical circuitry, schematically shown at 330.

FIGS. 15 and 16 are like FIGS. 7 and 8, and corresponding elements bear the same numerals. In addition, the contact body 12, and preferably its lower generally annular portion 15, has a sidewardly projecting retainer means for penetrating into, and thereby locking to, the non-metallic corner means 122 corresponding panel 22 described above. The retainer means preferably comprises barb means or barbs 124 which taper forwardly, i.e., are shaped to resist rearward (upward) retraction from the carrier. The latter may consist of molded plastic material forming a cylindrical bore 128 into which the body 12 is downwardly inserted, the body outer surface closely fitting the bore 128. The shallow barbs penetrate that bore, laterally, and multiple such barbs may be located about the axis 13.

The contact 411 seen in FIGS. 17 and 18 is even further simplified. The bottom end 415*a* of the contact body portion 415 is closed and corresponds to closed end 115 seen in FIG. 7. Therefore, the contact can be mounted as in FIG. 11. The contact has no upper body portion corresponding to 14 in FIGS. 1 and 7.

Instead, the three spring fingers 417 have ends 417*a* anchored to the upper end of 415. The fingers project freely upwardly to have free ends 417*b*, and elongated mid-portions 417*c* deflected toward axis 413, and local inner grip extents 417*c*' for frictionally gripping the side wall of a terminal pin 419. Finger sections between 417*a* and 417*c*' taper upwardly toward axis 413, and finger sections between 417*c'* and 417*b* taper away from that axis to provide a receptacle for the pin.

In FIG. 19, the wall portion 415' is made to have six flat outer sides 415*d*, and six corners 415*e*. These being representative of multiple such slots. Such corners are defined by linear edges extending parallel to axis 413 at equal radial distances therefrom. Only such edges contact the cylindrical bore 426*a* of plastic carrier 426 for easing reception and guidance of the contact into that bore, i.e., into the carrier.

Figure 20:
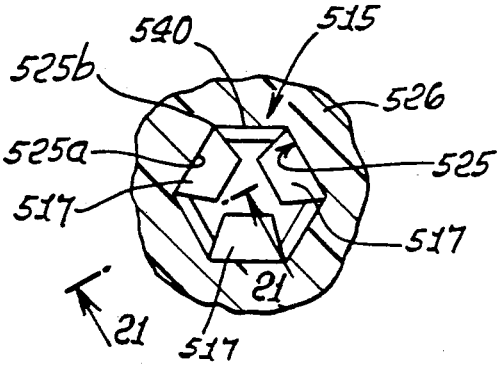
FIG. 20 is a view like FIG. 18 showing a further modification.
Figure 21:
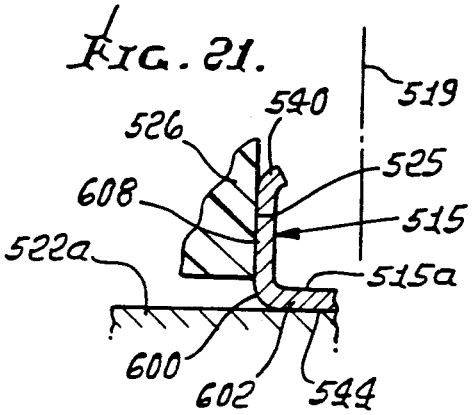
FIG. 21 is a section taken on lines 21—21 of FIG. 20.

In FIG. 20, the modified body 515 is like body 415 in FIG. 17 except that it has a hexagonal shape in cross section, as shown. That shape fits in the hexagonal shape of the bore 525 in the plastic carrier 526. See the flats 525*a* that merge at edges 525*b*. Thus, the one-piece metallic contact 511 is retained against rotation as during vibrations. The three spring fingers 517 are like those at 417 in FIGS. 17 and 18. Also, it can be inserted into the throughbore of the carrier from the bottom thereof, i.e., upwardly. As also seen in FIG. 20, the fingers 517 project inwardly only from alternate flats about the body axis; also, the fingers have maximum width substantially equal to the width of the flats from which they project, respectively.

Rolling or swaging of the body outer edges 540, between the spring fingers and toward axis 519, prevents "hang up" of those edges against the bore walls of the plastic carrier during such upward insertion. Note attachment at 544 of flat bottom 515*a* of the contact to horizontal support surface 522*a*.

Note the generally annular, outwardly convex corner surface 600 between the body side wall 608 and the flat lower end 602. This convexity ends downward insertion of the unitary contact into the carrier bore.

I claim:

1. An electrical contact comprising, in combination:

(a) a generally tubular metallic body defining an axis which is vertically elongated, having an upper generally annular portion and a lower generally annular portion spaced axially below said upper portion, (b) multiple like elongated spring fingers spaced at equal intervals about said axis and extending generally in the elongation direction of said body, there being at least three of said fingers which are spaced apart throughout their lengths, said fingers having (i) anchored ends integral with one of said generally annular portions, (ii) free ends spaced at equal distances from said anchored ends, and (iii) elongated mid-portions which are alike and deflected toward said axis, whereby said fingers may frictionally grip the exterior of a terminal pin inserted axially into said body, (c) the body having an open upper end, and a closed lower end adapted to mount the body on a panel to extend upwardly therefrom, (d) said body upper and lower generally annular ends being interconnected so that the body and spring fingers are unitary, (e) said fingers, throughout said midportions, extending arcuately about said axis to stiffen them against outward bending deflection as said pin is frictionally gripped by the fingers.

2. The combination of claim 1 wherein the body has wall portions extending between said upper and lower generally annular portions, and spaced about said axis, there being body wall openings defined between said wall portions, said spring fingers located between said wall openings and said axis.

3. The combination of clam 1 wherein said elongated mid-portions of spring fingers taper linearly toward said axis.

4. The combination of claim 1 wherein said elongated mid-portions of the spring fingers have certain sections that taper toward said axis, and other sections that taper away from said axis.

5. The combination of claim 1 wherein said body closed lower end is surface mounted to said panel.

6. The combination of claim 1 including said panel onto which said closed lower end is connected.

7. The combination of claim 1 including an elongated tubular stem integral with said body lower portion and projecting downwardly; axially, for reception in an opening forward in the panel.

8. The combination of claim 7 including said panel forming said opening, and into which said stem projects and fits.

9. The combination of claim 1 including said pin received into said body and having a side wall engaged by said spring fingers.

10. The combination of claim 9 including a chip body carrying said pin, there being electrical circuitry defined in said chip body.

11. The combination of claim 1 including multiple of said contacts extending in laterally spaced, longitudinally axially parallel relation; and a carrier for said contacts and extending closely about said body upper and lower annular portions to hold said contacts in said axially parallel relation.

12. The combination of claim 11 wherein said carrier consists of molded plastic material.

13. The combination of claim 12 wherein said carrier has reduced thickness at regions intermediate successive of the contacts to provide preferential break-away loci.

14. The combination of claim 13 wherein said body is sidewardly notched to define said reduced thickness regions.

15. The combination of claim 1 wherein the body has sidewardly projecting retainer means everywhere spaced from the fingers for penetration into non-metallic carrier means extending about the body.

16. The combination of claim 15 wherein said retainer means is integral with the body generally annular lower portion.

17. The combination of claim 15 including said carrier defining a bore into which the body projects axially, the bore penetrated by said retainer means.

18. The combination of claim 15 wherein the retainer means comprises the barb means.

19. The combination of claim 18 including said carrier which consists of molded plastic material and which defines a bore into which the body projects axially, the barb means penetrating said bore.

20. An electrical contact comprising, in combination, a) a generally tubular metallic body defining an axis which is vertically elongated, b) at least three elongated spring fingers extending generally in the elongation direction of said body, said fingers spaced about said axis, said fingers having i) anchored ends integral with one end portion of said body, ii) free ends spaced from said anchored ends, and iii) elongated mid-portions which are deflected toward said axis, whereby said fingers may frictionally grip the exterior of a terminal pin inserted axially into said body, c) and including a panel having a mounting surface extending normal to said axis, the body having a flat, lower end surface extending normal to said axis and attached to said panel mounting surface to provide a support mounting the body on the panel to extend vertically therefrom, d) the body and spring fingers being unitary.

21. The combination of claim 20 wherein the free ends of the fingers projects away from said body lower end.

22. The combination of claim 20 wherein the free ends of the fingers project toward said body lower end.

23. The combination of claim 20 wherein the tubular body is confined below said fingers.

24. The combination of claim 20 wherein said elongated mid-portions of the spring fingers have certain sections that taper toward said axis, and other sections that taper away from said axis.

25. The combination of claim 20 wherein the body has edge means located between said fingers, said edge means deformed toward said axis.

26. The combination of claim 20 wherein the body has a side wall and also has a generally annular, outwardly convex junction between said lower end and said side wall.

27. The combination of claim 20 wherein the body has a series of circumferentially spaced linear corners extending parallel to said axis for guiding the body in contact with a bore in a carrier, the body having an outer surface that defines flats between said corners, the fingers projecting inwardly only from alternate flats about said axis, the fingers having maximum width substantially equal to the width of the flats from which they project.

28. The combination of claim 27 including said carrier, and below which said body lower end projects.

29. The combination of claim 27 wherein there are ten of said corners.

30. The combination of claim 27 wherein the body has an outer surface that defines flats between said corners.

31. The combination of claim 20 including said carrier forming a through bore to closely receive said body, the bore having a series of corners extending parallel to said axis, and a series of flats between said corners, said flats engageable by the body.

32. The combination of claim 31 wherein the body also has a corresponding series of corners and flats configured to interfit the corners and flats of the carrier bore.

* * * * *